United States Patent [19]

Holloway et al.

[11] Patent Number: 4,644,340

[45] Date of Patent: Feb. 17, 1987

[54] PROGRAMMABLE TIMING CIRCUIT FOR CATHODE RAY TUBE

[75] Inventors: Brian L. Holloway; Roger J. Llewelyn, both of Winchester, England

[73] Assignee: International Business Machines Corporation, Armonk, N.Y.

[21] Appl. No.: 562,949

[22] Filed: Dec. 19, 1983

[30] Foreign Application Priority Data

Jun. 30, 1983 [EP] European Pat. Off. ..... 83303792.2

[51] Int. Cl.[4] ..... G09G 1/16

[52] U.S. Cl. ..... 340/749; 340/724

[58] Field of Search ..... 340/722, 724, 749, 814, 340/744

[56] References Cited

U.S. PATENT DOCUMENTS

| | | | |
|---|---|---|---|
| 3,396,377 | 8/1968 | Strout | 340/749 |
| 3,522,597 | 8/1970 | Murphy | 340/724 |
| 4,232,374 | 11/1980 | Chung et al. | 364/900 |

OTHER PUBLICATIONS

IBM Technical Disclosure Bulletin, vol. 19, No. 3, Aug. 1976, pp. 1081–1084, D. J. Chesarek, "Formattable Video Band Display".

IEEE Transactions on Consumer Electronics, vol. CE-27, No. 4, Nov. 1981, pp. 612–625, F. L. Toth, "New Ultra Low Cost CRT Controller is Ideally Suited to Personal Computer and Electronic Games Applications".

*Primary Examiner*—Marshall M. Curtis

*Attorney, Agent, or Firm*—Joseph J. Connerton

[57] ABSTRACT

A programmable timing circuit for a cathode ray tube includes a register stack (48) in which events to be timed are stored so that they are presented to comparators (45, 46 or 47) in the sequence in which they will occur. Each event is coded in terms of the position (character, line or row) on the screen at which it is to occur and flags stored with the values are decoded to identify the event being timed when a match is found between the presented value and the count in a character, line or row counter (40, 41 or 42) which is indicative of the current beam position on the screen. Values in the register stack can also control internal operations of the timing circuit, for example re-setting counters or re-addressing the stack.

6 Claims, 5 Drawing Figures

PROGRAMMABLE TIMING CIRCUIT FOR CATHODE RAY TUBE

BACKGROUND OF THE INVENTION

This invention relates to a programmable timing circuit for a cathode ray tube.

As is well known, a cathode ray tube requires various timing signals for its correct operation. Typically signals are required at start/stop horizontal synchronization, start/stop blanking, end of raster scan line, end of frame, cursor, indicator row, etc. Early cathode ray tubes had dedicated timing circuits but in more recent years programmable timing circuits have been provided. These can be adapted to a particular CRT display by loading various parameters into the circuit.

Typical of such a programmable timer is that sold by Motorola Inc. as the Motorola 6845 circuit. In prior art timers, each programmable timer normally requires its own register and comparator which compares the contents of the register continuously with a counter. Whenever a comparison is detected, the appropriate timing signal is derived.

Patent Specification GB-A No. 2,075,791 describes a programmable timing signal generator which includes a small random access memory in which each word stored corresponds to a timing state and each output bit provides a sync video related signal. This is not a generator designed to give control outputs at particular points on the screen, having no character, row or line counters. It produces complete pulse sequences in short high resolution bursts separated by long time intervals.

SUMMARY OF THE INVENTION

An object of the present invention is to provide a programmable CRT timing circuit which, once loaded with desired values, requires only simple recycling and addressing to derive the required signals and which can be readily implemented in large scale integrated circuits.

According to the invention, a programmable timing circuit for a cathode ray tube comprises a counter for containing a count indicative of the position of the electron beam as it scans across the face of the cathode ray tube, comparison means for comparing the count in the counter with a stored value indicative of when an event is to occur and means for generating a timing signal when a match is obtained, characterized in that a plurality of stored values are stored in a register stack in such a manner as to be presented in the correct sequence in which events are to occur to said comparator means, said generating means being operable to decode a flag indicative of the event when said match is detected.

In a microprocessor controlled CRT display, it is preferred if the register stack includes a read only storage (ROS) area for use until the microprocessor has loaded the loadable portion of the stack. When in the default state, that is immediately after power on, the address mechanism ensures that only the events coded in ROS are presented to the comparators.

BRIEF DESCRIPTION OF THE DRAWINGS

The invention will now be described, by way of example, with reference to the accompanying drawings, in which.

DESCRIPTION OF A PREFERRED EMBODIMENT

Figure 1:
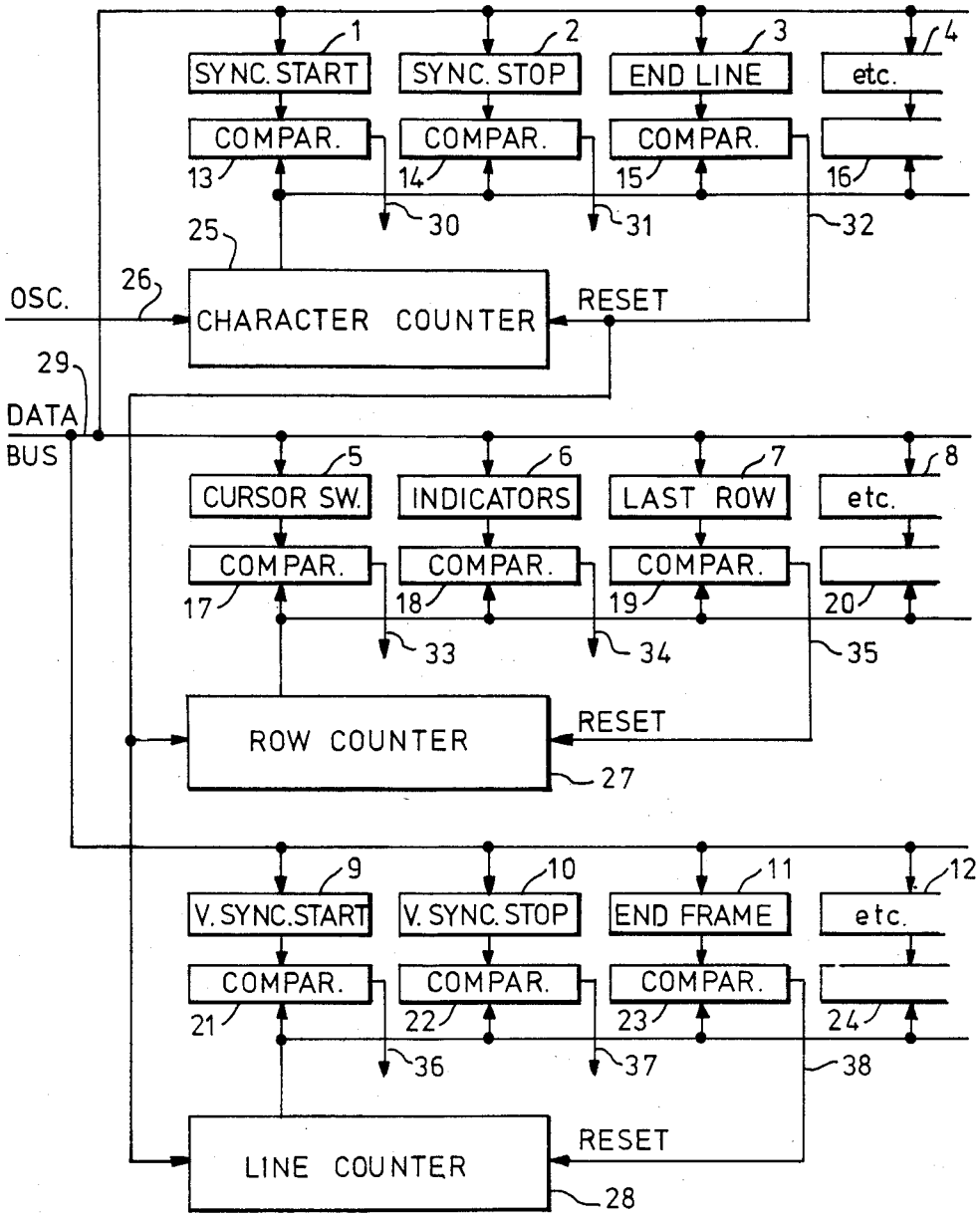
FIG. 1 (PRIOR ART)
FIG. 1 shows the organization of a typical prior art programmable CRT timer.

Referring now to FIG. 1 which shows a typical prior art CRT timer, registers 1 to 12 are provided, one for each event for which a timing signal is required. Associated with registers 1 to 12 are comparators 13 to 25 respectively. The registers and associated comparators are grouped together into three groups in accordance with whether the timing signal is dependent upon character position, row position or line position. Within this specification, the character position is the horizontal position along the horizontal raster scan line. Thus if the CRT display can display up to 80 characters across its screen, there will be up to 80 screen character positions plus a further number of non-displayable character positions (form example 20) to allow for line flyback. The row position is the vertical position of the row of characters, for example it may be possible to display up to 24 rows of characters. The line position is the vertical position of the scan line: for example if each row of displayed characters requires 12 raster scan lines, 24 rows would require 288 scan lines.

Character counter 25, incremented by an oscillator on line 26, will contain the current horizontal position of the electron beam as it raster scans across the screen. Row counter 27 will contain the current row position and line counter 28 will contain the current scan line position. By means of a data bus 29, various values can be entered into the registers 1 to 12.

Typical of events which depend on the horizontal position of the beam, i.e. the character count, are horizontal synchronization start, horizontal synchronization stop, end of scan line etc. and the appropriate counts at which these events are to occur are loaded into registers 1 to 4. When a comparison is detected, a signal on the output lines 30 to 32 will indicate the timing of that event. The end-of-line output 32 is used to reset the character counter 25 and to increment the line counter 28. FIG. 1 is somewhat simplified in showing output line 32 incrementing row counter 27. In practice the row counter would be incremented at the end of a scan line only if that were the last scan line (for example the eighth) of a character row.

Similarly, counts of events which depend on the row count or the scan line count are loaded on data bus 29 into appropriate registers. Whenever the appropriate counts are detected, an output is signalled on lines 33 to 38. Although this circuit arrangement works, it has some drawbacks. It is relatively expensive, since each programmable timer requires a register and comparator. Also, once the basic display characteristics have been fixed, it might be difficult, if not impossible, to add new features rather than re-time existing features.

Figure 2:
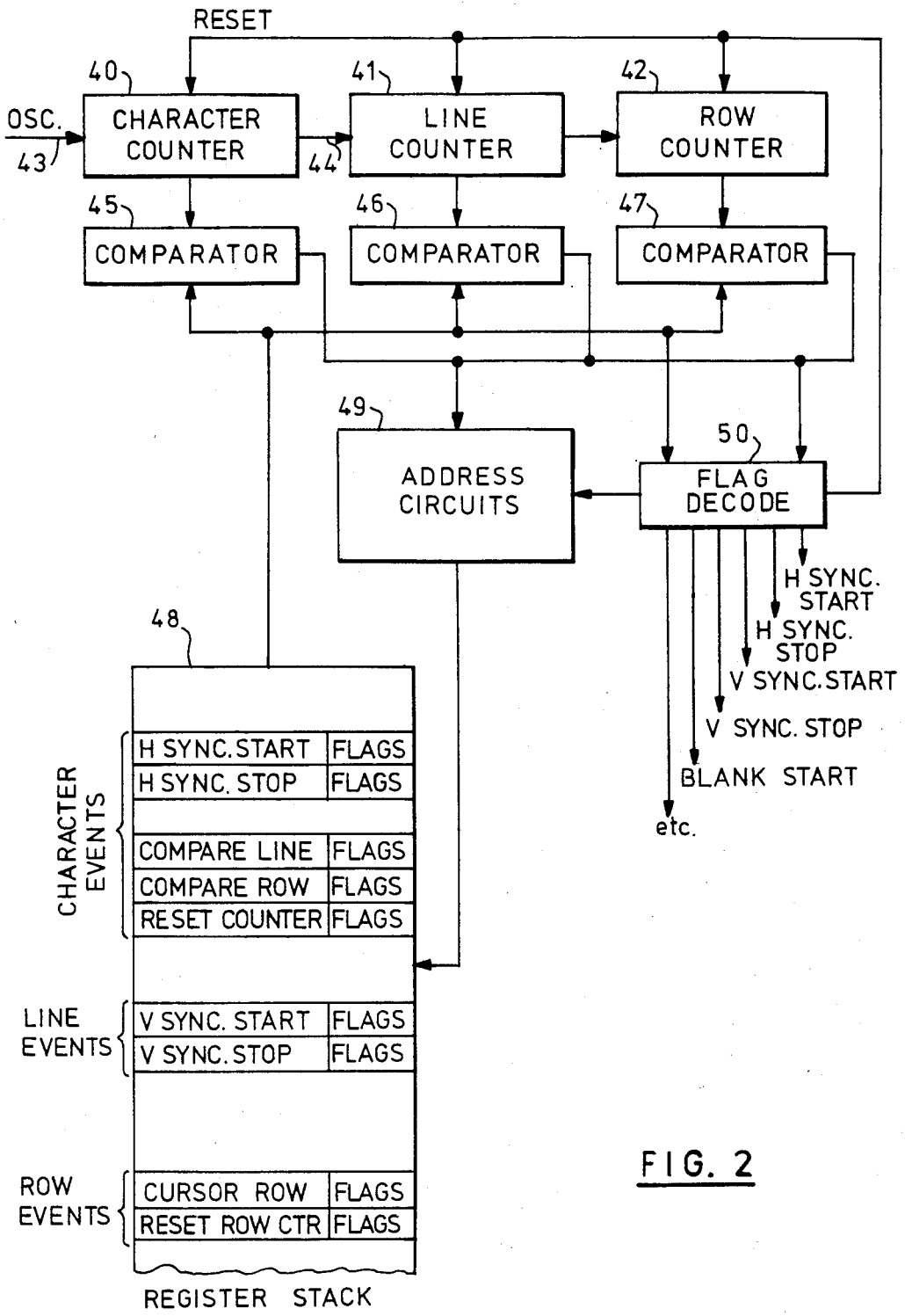
FIG. 2 is a block diagram of a preferred embodiment of the invention showing the use of a register stack.

However, the timing circuit shown in FIG. 2 only requires three comparators, one for each group of events and, instead of separate registers, makes use of a register stack. This makes for a much more versatile arrangement which is also more suitable for implementation in large scale integration (LSI).

As shown in FIG. 2, three counters 40 to 42 contain the current character, line and row counts respectively. Character counter 40 is incremented by an oscillator on line 43. Every so often, in fact when it is reset, counter 40 will increment line counter 41 on line 44. Similarly every few scan lines, row counter 42 will be incremented. Each counter has associated therewith a comparator 45, 46 or 47. Thus comparator 45 is used for deriving the timing of character events, comparator 46 for line events and comparator 47 for row events.

All events that require timing are loaded into a register stack 48 in the sequence in which they will occur. Each entry in the stack 48 has flags to identify the event being timed. In operation, address circuits 49 cause the first entry to be presented to the comparators 45 and when a comparison is achieved, the flags in that entry are decoded in flag decoder 50 to indicate the nature of the event, for example H sync start. Each time a compare is achieved, the address circuitry 49 advances to present the next entry in the register stack 48 to the comparator.

Stack entries may include events that call for internal operations such as resetting the character or other counter. Similarly a stack entry may call for a different area of the stack (that is non-sequential), for example that containing line or row timings, to be compared with another counter, the line or row counter. In this way, all programmable events may be contained in a single area of random access memory. The arrangement shown is preferred since it is convenient to group together the character, line or row dependent events. However, it is possible to use only one counter and one comparator since all events can be timed on the character counts if this runs from 0 at the top left of the screen to the maximum count at the bottom right. In this event, every event would be loaded strictly in sequence.

It may be convenient to provide a default set of timings for use when the programmable timers are not loaded in the register stack. In this event a small read only store (ROS), not shown, could provide the default set. When in the default state, for example, immediately after power on of the display, the address circuitry 49 would ensure that only the events coded in the ROS are presented to the comparators.

Figure 3:
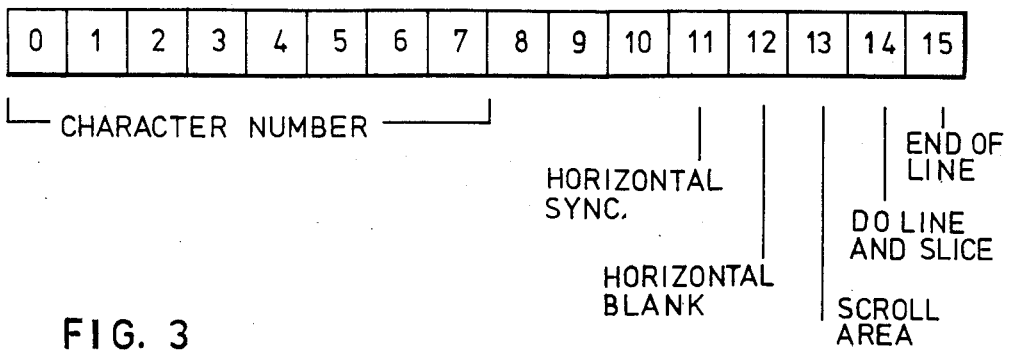
FIGS. 3 to 5 show the format of various entries in the register stack.

FIG. 3 shows the format of the entries in the stack register for character events. Eight events may occur during a scan line:

Horizontal synchronization start/stop
Blanking start/stop
Scroll area enter/leave
Frame and slice position check
Line end.

Eight locations in the stack are reserved for these horizontal or character events and are coded as shown in FIG. 3. When the character number in fields 0 to 7 compares with the character counter, the flags in fields 11 to 15 are examined in decoder 50 (FIG. 2) and the appropriate action taken. For example, a "1" on the sync flag will cause a 'set' to a sync latch, not shown, and a "0" a reset. The End of Line flag causes the character counter 40 to reset. The Do Line and Slice flag causes a compare of the line stack with the line counter 41, followed by similar compares on the slice and scroll slice counters. Several characters with no line events should follow the Do Line and Slice event.

Figure 4:
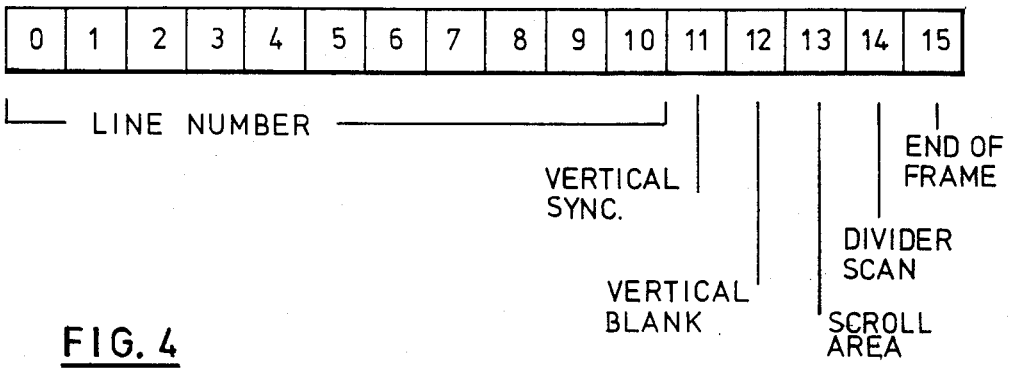
Figure 5:
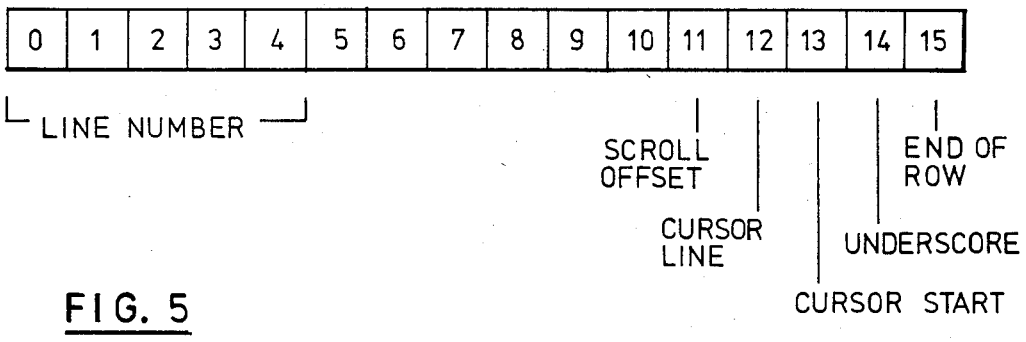

A similar coding scheme applies to FIG. 4 which shows Vertical Frame or Line Events and FIG. 5 which shows Vertical Slice or Row Events.

Once per line, under control from the character Event stack, the row counter 42 is compared with the slice or row event stack from line counter 21. If the number compares, the flags are inspected and the appropriate latches (not shown) set or reset. If scroll offset is active, the row counter 42 is reset and scroll control logic (not shown) is signalled to indicate that a row boundary has been crossed. The row counter is also compared with the row event stack once per scan line to determine the events active on the row scan line. These events (e.g. under score) are held in separate latches (not shown).

As the Timing and Sync circuit relies on the sequential retrieval of events from the stack, the microcode or other control logic must ensure that the stack is loaded in the corresponding sequence. Hence when changing event timings, some re-ordering may become necessary.

The following is a list of the parameters that may be programmed within the timer:

1. Horizontal Scan Line Length
   Total number of characters per scan line, i.e. defines horizontal sync period. (8 bits allowing up to 256 characters including flyback.)
2. Horizontal Sync Start Position
   Character number of sync start (8 bits).
3. Horizontal Sync Stop Position
   Character number of sync stop (8 bits).
4. Horizontal Margin Start Position
   Defines the start of the horizontal blanking (8 bits)
5. Horizontal Margin Stop Position
   Defines the stop of the horizontal blanking (8 bits).
6. Vertical Display
   Total number of scan lines in the display, i.e. defines the vertical sync period (10 bits allowing up to 1024 lines including flyback).
7. Vertical Sync Start Position
   Line number of the start of the vertical sync pulse (10 bits).
8. Vertical Sync Stop Position
   Line number of the stop of vertical sync (10 bits).
9. Vertical Margin Start Position
   Line number defining the start of vertical blanking (10 bits).
10. Vertical Margin Stop Position
    Defines the stop of the vertical blanking (10 bits).
11. Number of Scan Lines Per Character Row
    Defines the total number of scan lines per row (5 bits).
12. Underscore Line
    Defines line number on which the underscore is to appear (5 bits).
13. Cursor Start Line
    Defines line number on which the reverse cursor is to start (5 bits).
14. Cursor Line
    Defines line number on which the reverse cursor is to stop or on which the normal cursor is to be drawn (5 bits).
15. Scroll Offset
    Defines number of scan lines a scroll counter is offset from the main row counter (5 bits).
16. Scroll Partition Start Character
    Defines character number on which the partition to be scrolled starts (8 bits).
17. Scroll Partition Stop Character
    Defines character number on which the partition to be scrolled stops (8 bits).
18. Scroll Partition Start Line
    Defines the line number on which the partition to be scrolled starts (10 bits).
19. Scroll Partition Stop Line Defines the line number on which the partition to be scrolled stops (10 bits).

The various analog circuits which would co-act with the timer shown in FIG. 2 are not shown since they do not form part of the present invention. Similarly no details of the overall control logic of the display is shown. Typically, however, the display could be controlled by a microprocessor in a similar manner to the well known IBM 8775 display station. However, the invention is not limited to use in such a microprocessor-controlled display.

We claim:

1. A programmable timing circuit for a cathode ray tube display comprising in combination a plurality of counters containing counts indicative of the position of the electron beam as it scans across the face of said cathode ray tube, means for comparing the count in each of said counters with a stored value indicative of when a specified event is to occur, means for generating a control signal when a match is detected by said comparator means and a plurality of values representative of programmed events stored in a register stack in such a manner as to be presented to said comparator means in the sequence in which events are to occur, said control signal generating means being operable to decode a flag indicative of the event when said match is detected.

2. A programmable timing circuit as claimed in claim 1, comprising a character counter incremented for each character position in a scan line, a line counter incremented for each raster scan line, a row counter incremented for each row of displayed characters and respective comparators for comparing the contents of the character, line and row counters with values presented in sequence from said register stack, in which values stored in said register stack are grouped therein in accordance with whether they are dependent upon character, line or row positions, means responsive to said stack entries for controlling both the basic scan parameters and internal operation of said programmable timing circuit.

3. A programmable timing circuit as claimed in claim 2, in which values for causing resetting and/or incrementing of each counter are stored in said register stack.

4. A programmable timing circuit as claimed in claim 2, comprising addressing circuit means operable under control of said generating means to present the next sequential value stored in said register stack to said comparison means.

5. A programmable timing circuit as claimed in claim 4, in which values for causing non-sequential access by said addressing means are stored in said register stack.

6. A programmable timing circuit as claimed in claim 2 comprising a read only store containing default values and means for presenting said default values sequentially to said comparison means until said register stack has been loaded with values representative of said programmed events.

* * * * *